United States Patent [19]

Silverstrone

[11] Patent Number: 4,703,538

[45] Date of Patent: Nov. 3, 1987

[54] CLEANING TOOL

[76] Inventor: Catherine A. Silverstrone, 14 Page Rd., Bedford, Mass. 01730

[21] Appl. No.: 793,960

[22] Filed: Nov. 1, 1985

[51] Int. Cl.[4] ..... A47L 13/00

[52] U.S. Cl. ..... 15/104 R; 15/104 A; 15/159 A; 15/160; 15/210 R

[58] Field of Search ..... 15/104 R, 104 A, 142, 15/159 A, 210 R, 230.11, 230.17, 179, 160, 1

[56] References Cited

U.S. PATENT DOCUMENTS

| | | | |
|---|---|---|---|
| 3,556,667 | 1/1971 | Kaufman | 15/159 A |
| 3,583,057 | 6/1971 | Kolozsvary | 15/230.11 X |
| 3,943,592 | 3/1976 | Bhaskar et al. | 15/159 A |
| 4,208,758 | 6/1980 | Timmis et al. | 15/159 A X |
| 4,627,126 | 12/1986 | Nichols | 15/104 A |

FOREIGN PATENT DOCUMENTS

| | | | |
|---|---|---|---|
| 332759 | 11/1958 | Switzerland | 15/231 |

*Primary Examiner*—Edward L. Roberts
*Attorney, Agent, or Firm*—Irving M. Kriegsman

[57] ABSTRACT

A cleaning tool which is especially suited for picking up dirt, lint and the like from rugs, floors, upholstered furniture and other surfaces is disclosed. The cleaning tool comprises, in one embodiment of the invention an elongated stick shaped handle, a pair of legs extending outward from one end of the handle, a cylindrically shaped cleaning element having an external surface made of Velcro, a disc with teeth on its periphery fixedly mounted at each end of the roller shaped cleaning element and a disc with slots fixedly mounted at the outer end of each leg, each slotted disc being adapted to fixedly and matingly engage one of the discs at the ends of the cleaning element. In use, the cleaning tool is pushed over the surface to be cleaned.

4 Claims, 2 Drawing Figures

CLEANING TOOL

BACKGROUND OF THE INVENTION

The present invention relates generally to cleaning tools and more particularly to a cleaning tool that is particularly effective in picking up dirt, lint and the like from rugs, floors, furniture and so forth.

It is an object of this invention to provide a new and improved cleaning tool.

It is another object of this invention to provide a cleaning tool which is easy and economical to produce.

It is yet still another object of this invention to provide a cleaning tool which does not contain any motors.

It is a further object of this invention to provide a cleaning tool which utilizes the clinging and dirt collecting properties of Velcro.

The foregoing and other objects and advantages will appear from the description to follow. In the description, reference is made to the accompanying drawing which forms a part thereof, and in which is shown by way of illustration, a specific embodiment for practicing the invention. This embodiment will be described in sufficient detail to enable those skilled in the art to practice the invention, and it is to be undertood that other embodiments may be utilized and that structural changes may be made without departing from the scope of the invention.

The following detailed description is, therefore, not to be taken in a limiting sense, and the scope of the present invention is best defined by the appended claims.

SUMMARY OF THE INVENTION

A cleaning tool which is especially suited for picking up dirt, lint and the like from rugs, floors, upholstered furniture and other surfaces constructed according to the teachings of the present invention comprises, in one embodiment of the invention, an elongated stick shaped handle, a pair of legs extending outward from one end of the handle, a cylindrical shaped cleaning element having an external surface made of Velcro, a disc with teeth on its periphery fixedly mounted at each end of the cylindrically shaped cleaning element and a disc with slots fixedly mounted at the other end of each leg, each slotted disc being adapted to fixedly and matingly engage one of the discs at the ends of the cylindrically shaped cleaning element. In use, the cleaning tool is pushed over the surface to be cleaned.

BRIEF DESCRIPTIONS OF THE DRAWINGS

In the drawings herein like reference numerals represent like parts:

FIG. 1 is a perspective view, partly, disassembled of one embodiment of a cleaning tool constructed according to one embodiment of the invention; and FIG. 2 is a perspective view of another embodiment of the invention.

DETAILED DESCRIPTION OF PREFERRED EMBODIMENTS

Figure 1:
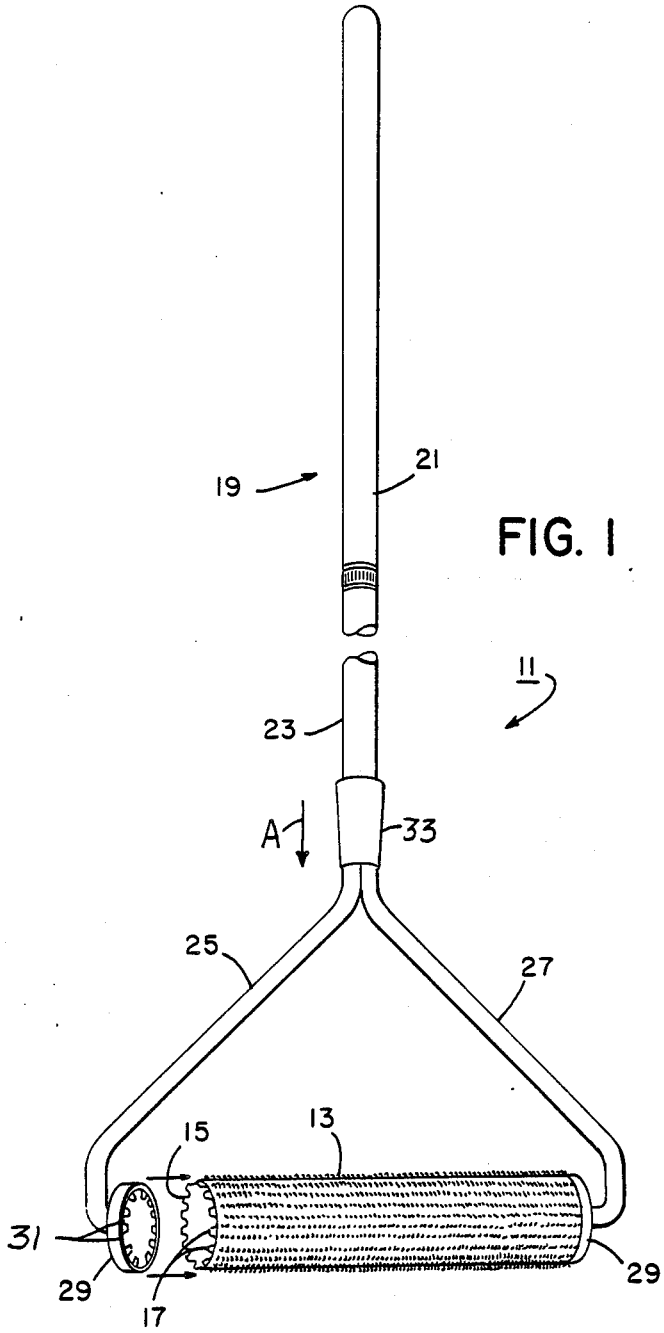

Referring now to the drawings, there is shown in FIG. 1 an embodiment of a cleaning tool constructed according to the teachings of the present invention and identified generally by reference numeral 11.

Cleaning tool 11 includes a cleaning element 13 which is made up of a elongated hollow rigid plastic cylinder which is covered on its outer surface with a sheet of Velcro. The sheet of Velcro is secured to the cylinder by any suitable means, such as glue. A disc 15 made of plastic and having teeth 17 on its peripheral surface is fixedly attached, such as by glue, to each end of roller 13.

Cleaning tool 11 further includes a handle assembly 19 having an upper section 21 and a lower section 23. Upper section 21 is an elongated hollow rod made of plastic and is press-fit into lower section 23. Lower section 23 is an elongated hollow member made of plastic and terminates in a pair of legs 25 and 27 arranged to define a yoke. A disc 29 made of plastic and having a plurality of circumferential slots 31 is fixedly mounted, such as by glue, to the end of each leg 25, 27. Instead of being separate from and then attached to legs 25 and 27, the discs 29 and legs 25 and 27 may be a unitary structure. Discs 29 are sized so that they can be press fit over discs 15 with teeth 17 mating with slots 31.

Finally, cleaning tool 11 includes a plastic sleeve 33 which is slidably mounted on handle assembly 19.

In assemblying cleaning tool 11 for operational use, discs 29 are press fit into cleaning discs 15 at the ends of cleaning element 13. Sleeve 33 is then slid down in the direction shown by arrow A so as to prevent legs 25 and 27 from being pulled apart.

As can be appreciated, cleaning element 13 can be easily replaced, as necessary, when worn out or too inundated with dirt.

Instead of being press-fit, upper section 21 of handle assembly 19 can be telescopingly mounted in lower section 23 so that the overall length of handle assembly may be adjusted without actually removing a part. Also, if adjustability is not desired, upper section 21 and lower section 23 may be a unitary structure.

Figure 2:
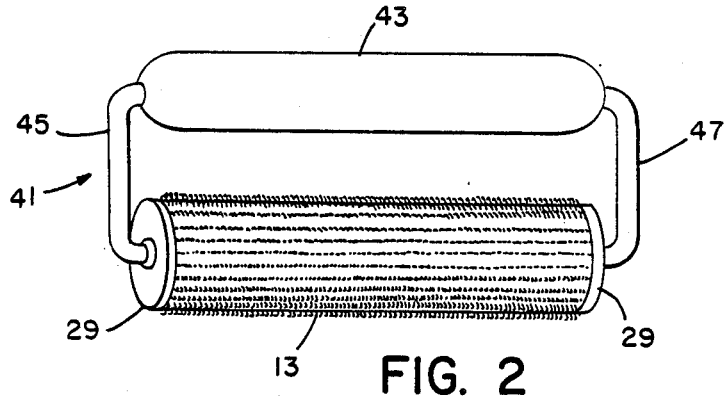

Referring now to FIG. 2 there is illustrated another embodiment of a cleaning tool constructed according to the invention and identified by reference numeral 41.

Cleaning tool 41 includes a cleaning element 13. A pair of discs 15 (not shown) having teeth on their periphery are fixedly attached to the ends of roller 13 as in the FIG. 1 embodiment. Cleaning tool 41 further includes a handle 43, a pair of "C" shaped legs 45 and 47 extending out from handle 43 and a pair of discs 29 fixedly attached to the legs 45 and 47. Cleaning element 13 may be replaced, as necessary by simply pulling apart legs 45 and 47. Handle 43 and legs 45 and 47 may be made of plastic. Legs 45 and 47 and handle 43 may be a unitary structure.

It should be noted that, in both embodiments, cleaning element 13 does not rotate when the tool is being used but, rather, is simply pushed along the surface to be cleaned.

Cleaning tool 11 with a relatively long handle, is intended to be used preferably on rugs, floors and the like, while cleaning tool 41 is intended to be used preferably on furniture or with items wherein the hand holding the tool is placed relatively close to the surface to be cleaned.

The embodiment of the present inventin is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A cleaning tool comprising:

a. a handle assembly, b. a cylindrically shaped cleaning element having an external surface of Velcro, and c. means mounting the cleaning element on the handle assembly for relative movement of the cleaning element with respect to the handle assembly for selective positioning of different areas of the cleaning element for contact with a work surface, d. whereby said cleaning element may be pushed over said work surface with an area of said Velcro surface in contact with said work surface.

2. The cleaning tool of claim 1 and wherein said cylindrically shaped cleaning element is a plastic cylinder and said external surface of Velcro is a sheet of Velcro fixedly attached to said external surface.

3. The cleaning tool of claim 2 and wherein said means for mounting said cylindrically shaped cleaning element to said handle assembly comprises:

a. a pair of discs fixedly mounted on the handle assembly, and b. a pair of discs fixedly mounted on said cylindrically shaped cleaning element and adapted to fixedly engage said pair of discs on said handle assembly.

4. The cleaning tool of claim 3 and wherein said discs on said handle assembly having slots which are adapted to engage teeth on said discs on said cylindrically shaped cleaning element.

* * * * *